US006148612A

United States Patent [19]

Yamashita et al.

[11] Patent Number: 6,148,612

[45] Date of Patent: Nov. 21, 2000

[54] ENGINE EXHAUST GAS CONTROL SYSTEM HAVING NOX CATALYST

[75] Inventors: Yukihiro Yamashita; Shigenori Isomura, both of Kariya, Japan

[73] Assignee: Denso Corporation, Kariya, Japan

[21] Appl. No.: 09/166,937

[22] Filed: Oct. 6, 1998

[30] Foreign Application Priority Data

Oct. 13, 1997 [JP] Japan ..... 9-279133
Mar. 23, 1998 [JP] Japan ..... 10-074183

[51] Int. Cl.[7] ..... F01N 3/00; F01N 7/00

[52] U.S. Cl. ..... 60/277; 60/274; 60/276; 60/285; 60/286; 60/297; 60/301; 60/303

[58] Field of Search ..... 60/285, 301, 297, 60/274, 286, 276, 303, 277

[56] References Cited

U.S. PATENT DOCUMENTS 4,526,001 7/1985 Burns et al. ..... 60/274
5,357,791 10/1994 Gee et al. ..... 73/118.1
5,402,641 4/1995 Katoh et al. ..... 60/277
5,433,074 7/1995 Seto et al. .
5,437,153 8/1995 Takeshima et al. ..... 60/276
5,450,722 9/1995 Takeshima et al. .
5,471,836 12/1995 Takeshima et al. .
5,473,887 12/1995 Takeshima et al. .
5,778,666 7/1998 Cullen et al. ..... 60/276
5,778,667 7/1998 Kinugasa et al. ..... 60/274
5,848,529 12/1998 Katoh et al. ..... 60/274
5,894,725 4/1999 Cullen et al. ..... 60/285

FOREIGN PATENT DOCUMENTS 0733787 9/1996 European Pat. Off. .
19607151 7/1997 Germany .
8-260948 10/1996 Japan .
8-261041 10/1996 Japan .

*Primary Examiner*—Jeanette Chapman
*Assistant Examiner*—Sneh Varma
*Attorney, Agent, or Firm*—Nixon & Vanderhye P.C.

[57] ABSTRACT

In an engine exhaust system, an NOx catalyst for occluding NOx in a state of the lean air-fuel ratio and reducing the occluded NOx in the state of the rich air-fuel ratio. A CPU sets a target air-fuel ratio of a mixture supplied to an engine to the lean side with respect to the stoichiometric air-fuel ratio for the lean mixture combustion. The CPU sets a rich time for a rich mixture combustion in accordance with the engine operating state and the NOx purification rate in the NOx catalyst. In this moment, the shortest rich time is set within a range in which a desired NOx purification rate by the NOx catalyst is obtained. A three-way catalyst may be arranged upstream of the NOx catalyst. The three-way catalyst carries only a noble metal such as platinum having no oxygen storing capability.

7 Claims, 12 Drawing Sheets

ENGINE EXHAUST GAS CONTROL SYSTEM HAVING NOX CATALYST

CROSS REFERENCE TO RELATED APPLICATION

This application relates to and incorporates herein by reference Japanese Patent Applications No. 9-279133 filed on Oct. 13, 1997 and No. 10-74183 filed on Mar. 23, 1998.

BACKGROUND OF THE INVENTION

1. Field of the Invention

The present invention relates to an engine exhaust gas control system for performing a lean mixture combustion in an air-fuel ratio lean zone and to an engine exhaust control system having an NOx occluding and reducing catalyst for purifying nitrogen oxides (NOx) in exhaust gas produced at the time of the lean mixture combustion.

2. Description of Related Art

In recent years, a lean air-fuel mixture combustion control is used for burning a fuel on the lean side relative to the stoichiometric air-fuel ratio in order to improve fuel consumption. When such a lean mixture combustion is performed, exhaust gas exhausted from the internal combustion engine includes a large quantity of NOx and an NOx catalyst for purifying NOx is therefore necessary. For example, JP patent No. 2600492 discloses an NOx absorbent (NOx occluding and reducing catalyst) for absorbing NOx when the air-fuel ratio of the exhaust gas is in the lean state and releasing the absorbed NOx when the concentration of oxygen in the exhaust gas is reduced, that is, when the air-fuel ratio is in the rich state.

On the other hand, in a system for absorbing NOx produced at the time of the lean mixture combustion by the NOx catalyst, when the NOx catalyst is saturated with NOx, the NOx purifying ability reaches the limit. Consequently, it is necessary to allow the rich mixture combustion to be temporarily performed in order to recover the purifying ability of the NOx catalyst and to suppress the exhaust of NOx.

However, when the lean mixture combustion is switched to the rich mixture combustion, the air-fuel ratio of the mixture near the Nox catalyst does not immediately change to the rich side. Consequently, it is necessary to set the rich time (rich mixture combustion period) rather long to continue the rich mixture combustion for a time including a time required for a gas condition in an exhaust pipe to shift from the lean state to the rich state. In such a case, when the rich mixture combustion is continued, the fuel injection amount is increased excessively, increasing fuel consumption. At the time of the rich mixture combustion, the engine generating torque is larger than that at the time of the lean mixture combustion. Consequently, when the rich time continues long, fluctuation in engine crankshaft rotation becomes large.

In JP patent No. 2586738, an NOx catalyst is disposed in an exhaust pipe and an NOx oxidant (oxidizing catalyst or a three-way catalyst) is disposed on the upstream side of the NOx catalyst. The catalyst on the upstream side generally carries platinum (Pt)—rhodium (Rh), and palladium (Pd), and ceria ($CeO_2$) as a co-catalyst and the like on a carrier. The oxygen is therefore stored in the catalyst and the stored oxygen reacts with the rich components (such as HC and CO) in the exhaust gas. Accordingly, the necessary amount of rich components cannot be supplied to the NOx catalyst disposed downstream of the oxidizing catalyst. Therefore, when the lean air-fuel mixture is burned, the oxygen is stored in the form of $Ce_2O_3$ and PdO, respectively. When the air-fuel ratio becomes rich, the $Ce_2O_3$ and PdO are turned into $CeO_2$ and Pd to release the stored oxygen. At this moment, the released oxygen reacts with the rich components in the exhaust gas so that the air-fuel ratio on the downstream side of the oxidizing catalyst does not change to the rich side. Consequently, the supply amount of the rich components to the NOx catalyst runs short. Thus, the reduction of the NOx occluded in the NOx catalyst becomes insufficient because of oxidizing catalyst.

SUMMARY OF THE INVENTION

It is an object of the present invention to provide an engine exhaust gas control system, which optimizes a rich mixture combustion time in a normal lean mixture combustion to recover the purifying ability of an NOx catalyst.

It is another object of the present invention to provide an engine exhaust gas control system, which increases the NOx purification rate while using an oxidizing catalyst and an NOx catalyst.

In an engine exhaust gas control system according to the invention, normally a lean air-fuel mixture is supplied to an internal combustion engine, so that NOx in exhaust gas is occluded by an NOx catalyst for occluding and reducing NOx. A rich air-fuel mixture is supplied only temporarily to the engine, so that the occluded NOx is released from the NOx catalyst. A rich time for a rich mixture combustion is controlled variably to a minimum. The rich time may be set in accordance with an engine operating state and an NOx purification rate of the NOx catalyst. Alternatively, the rich time may be set in accordance with an Nox purification state of the Nox catalyst. That is, the rich time may be shortened at every predetermined interval until the Nox purification state detected by a sensor indicates a limit of the rich time. Further alternatively, actual rich time may be estimated and a lean time may be set on the basis of the estimated actual rich time.

In an engine exhaust gas control system according to the present invention, an oxidizing catalyst is disposed upstream of the Nox catalyst. The oxidizing catalyst may carry only noble metals such as platinum incapable of storing oxygen on a carrier. Alternatively, the oxidizing catalyst may not carry a co-catalyst having a high oxygen storing ability on a carrier or carries only a small amount of the co-catalyst. The oxidizing catalyst may carry a small amount of noble metals to reduce the oxygen storing ability. It is preferable that a carrying amount in case of Rh is 0.2 grams/liter or less and that in case of Rd is 2.5 grams/liter or less.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF THE PREFERRED EMBODIMENT

The present invention will be described in detail with reference to various embodiments throughout which the same or like numerals are used to denote the same or like parts.

(First Embodiment)

Figure 1:
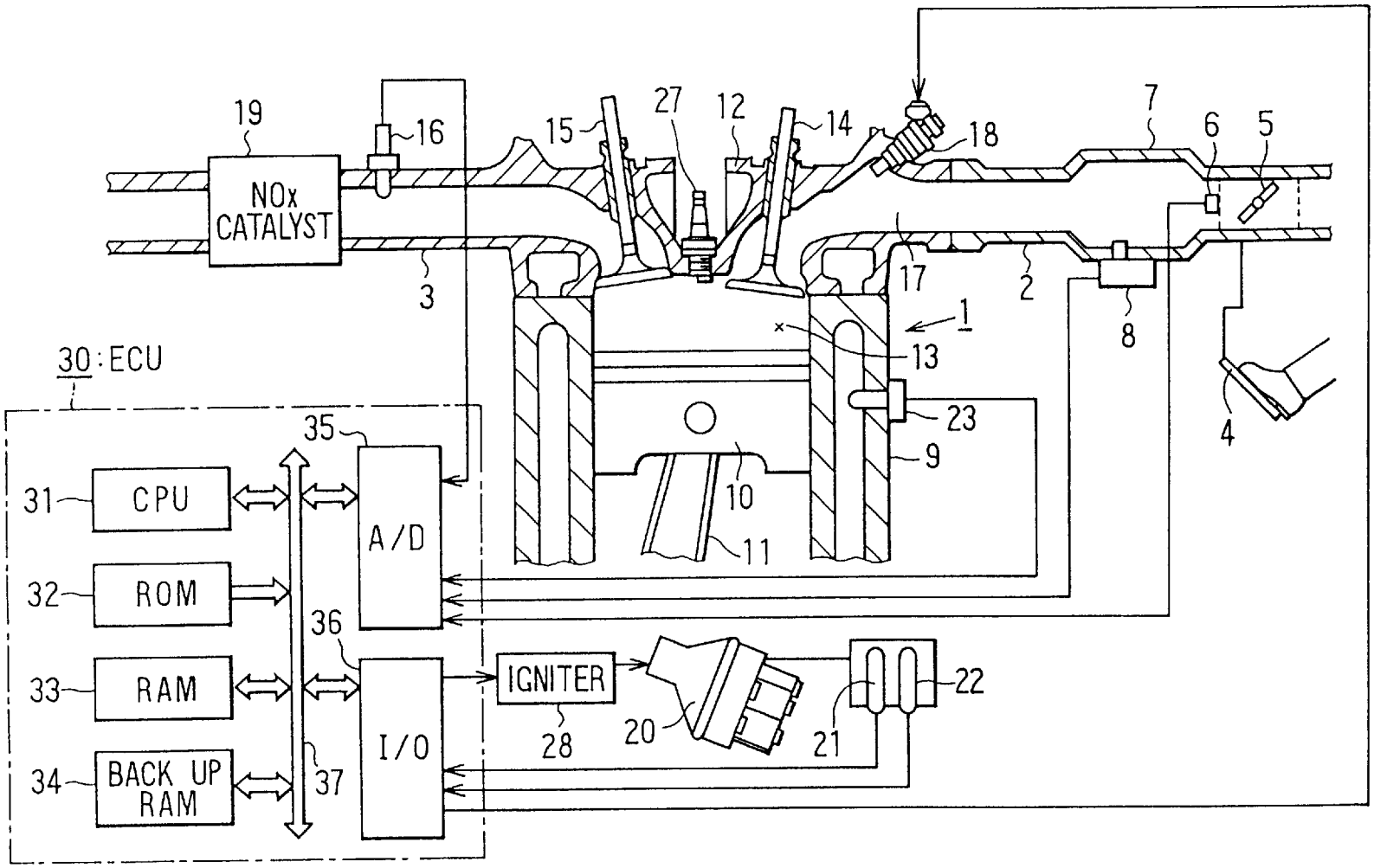
FIG. 1 is a schematic diagram showing an engine exhaust gas control system according to a first embodiment of the present invention.

Referring to FIG. 1, an internal combustion engine 1 is a four-cylinder four-cycle spark ignition type. An intake pipe 2 and an exhaust pipe 3 are connected to the engine 1. The intake pipe 2 is provided with a throttle valve 5 which operates interlockingly with an accelerator pedal 4. The opening angle of the throttle valve 5 is detected by a throttle valve sensor 6. An intake pressure sensor 8 is arranged in a surge tank 7 of the intake pipe 2.

A piston 10 is arranged in a cylinder 9 serving as a cylinder of the engine 1 and the piston 10 is connected to a crankshaft (not shown) via a connecting rod 11. A combustion chamber 13 defined by the cylinder 9 and a cylinder head 12 is formed above the piston 10. The combustion chamber 13 is communicated with the intake pipe 2 and the exhaust pipe 3 via an intake valve 14 and an exhaust valve 15.

The exhaust pipe 3 is provided with an A/F sensor 16 constructed by a limit-current type air-fuel ratio sensor for outputting a linear air-fuel ratio signal in a wide zone in proportion to the concentration of oxygen in the exhaust gas (or the concentration of carbon monoxide and the like in unburned gas). On the downstream side of the A/F sensor 16 in the exhaust pipe 3, an NOx catalyst 19 having the function of purifying NOx. The NOx catalyst 19 is known as an NOx occlusion and reduction type catalyst, which occludes NOx in the state of a lean air-fuel ratio and reduces and releases the occluded NOx in the form of CO and HC in the state of the rich air-fuel ratio.

An intake port 17 of the engine 1 is provided with an electromagnetically driven injector 18. A fuel (gasoline) is supplied from a fuel tank (not shown) to the injector 18. In the embodiment, a multipoint injection (MPI) system having injectors 18 for respective branch pipes of an intake manifold is constructed. In this case, a fresh air supplied from the upstream of the intake pipe and a fuel injected by the injector 18 are mixed in the intake port 17. The mixture flows into the combustion chamber 13 (cylinder 9) with the opening operation of the intake valve 14.

A spark plug 27 arranged in the cylinder head 12 ignites by a high voltage for ignition from an igniter 28. A distributor for distributing the high voltage for ignition to the spark plugs 27 of the cylinders is connected to the igniter 28. In the distributor 20, a reference position sensor 21 for generating a pulse signal every 720° CA in accordance with the rotating state of the crankshaft and a rotational angle sensor 22 for generating a pulse signal every smaller crank angle (for example, every 30° CA) are arranged. In the cylinder 9 (water jacket), a coolant temperature sensor 23 for sensing the temperature of coolant is arranged.

An ECU 30 is mainly constructed by a known microcomputer and has a CPU 31, a ROM 32, a RAM 33, a backup RAM 34, an A/D converter 35, an input/output interface (I/O) 36, and the like. Detection signals of the throttle opening angle sensor 6, the intake pressure sensor 8, the A/F sensor 16, and the water temperature sensor 23 are supplied to the A/D converter 35 and are A/D converted. After that, the resultant signals are fetched by the CPU 31 via a bus 37. The pulse signals of the reference position sensor 21 and the rotational angle sensor 22 are fetched by the CPU 31 via the input/output interface 36 and the bus 37.

The CPU 31 detects the engine operating states such as a throttle opening angle TH, an intake pressure PM, an air-fuel ratio (A/F), a coolant temperature Tw, a reference crank position (G signal), and an engine speed Ne. The CPU 31 calculates control signals of the fuel injection amount, ignition timing, and the like on the basis of the engine operating state and outputs the control signals to the injector 18 and the igniter 28.

The ECU 30 is programmed to execute various routines to control the exhaust gas.

A fuel injection control routine is executed by the CPU 31 at every fuel injection (every 180° CA in the embodiment) of each cylinder.

Figure 2:
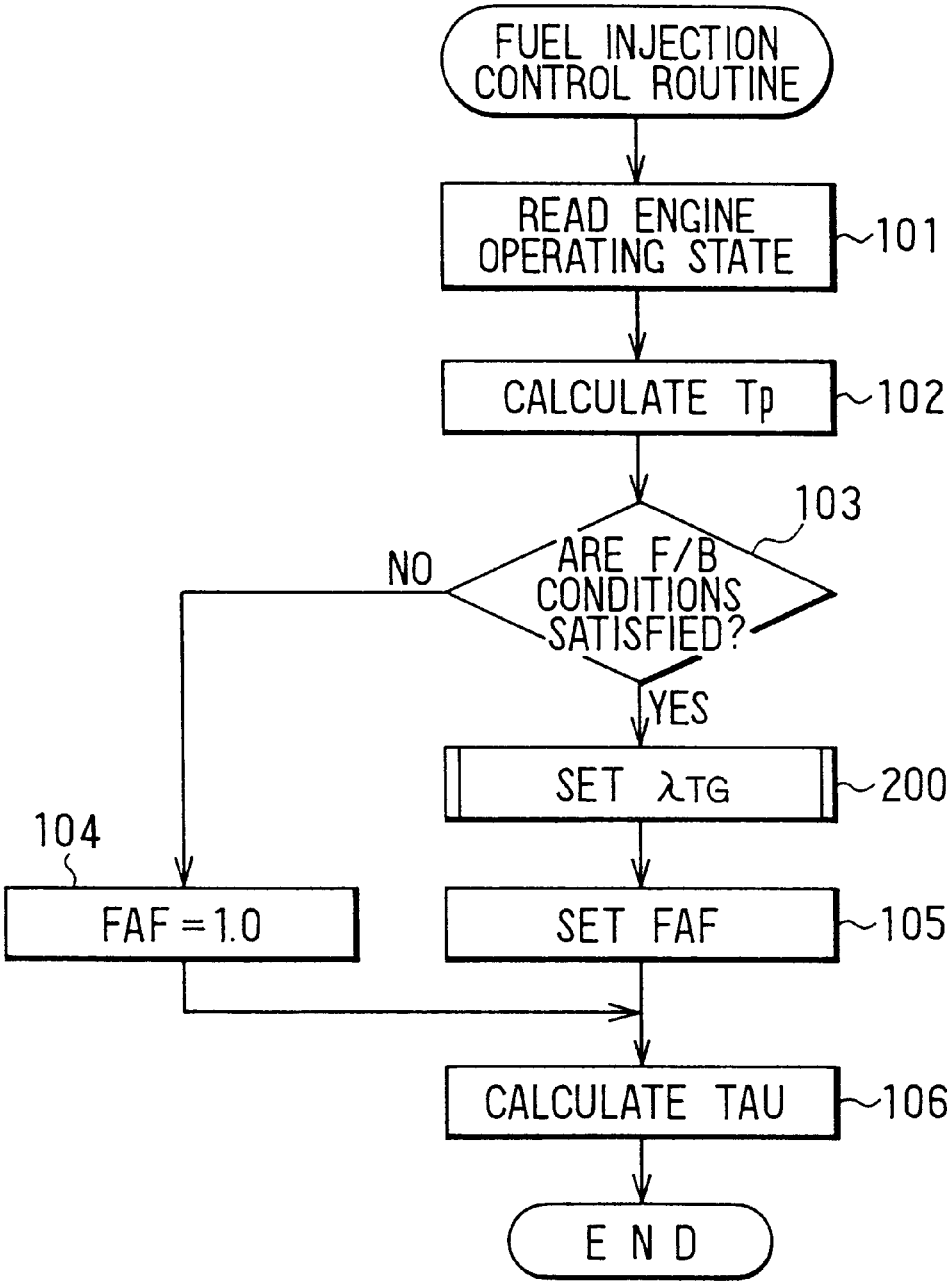
FIG. 2 is a flowchart showing a fuel injection control routine in the first embodiment.

When the routine of FIG. 2 starts, first in step 101, the CPU 31 reads a sensor detection result (engine speed Ne, intake pressure PM, coolant temperature Tw, and the like) showing the engine operating state. In step 102, the CPU 31 calculates a basic injection amount TP according to the engine speed Ne and the intake pressure PM at each time by using a basic injection map preliminarily stored in the ROM 32. The CPU 31 discriminates whether known air-fuel ratio F/B conditions are satisfied or not in step 103. The air-fuel ratio F/B conditions include a condition that the coolant temperature Tw is equal to or higher than a predetermined temperature, a condition that the rotation speed is not high and the load is not high, a condition that the A/F sensor 16 is in an active state, and the like.

When step 103 is negatively discriminated (when the F/B conditions are not satisfied), the CPU 31 advances to step 104 and sets an air-fuel ratio correction coefficient FAF to "1.0". Setting of FAF=1.0 denotes that the air-fuel ratio is open controlled. When step 103 is positively discriminated (when the F/B conditions are satisfied), the CPU 31 advances to step 200 and executes a process for setting a target air-fuel ratio λTG. The process for setting the target air-fuel ratio λTG is performed in accordance with the routine of FIG. 3 which will be described hereinlater.

After that, in step 105, the CPU 31 sets the air-fuel ratio correction coefficient FAF on the basis of the deviation of the actual air-fuel ratio λ (sensor measurement value) at each time from the target air-fuel ratio λTG. In the embodiment, the air-fuel ratio F/B control based on the advanced control theory is executed. The air-fuel ratio correction coefficient FAF to make the detection result of the A/F sensor 16 coincide with the target air-fuel ratio at the time of the F/B control is calculated by using the following (1) and (2) equations in the known manner.

$$FAF=K1\cdot\lambda+K2\cdot FAF1+\ldots+Kn+1\cdot FAFn+ZI \quad \ldots (1)$$

$$ZI=ZI1+Ka\cdot(\lambda TG-\lambda) \quad \ldots (2)$$

In the equations (1) and (2), λ denotes an air-fuel ratio conversion value of the limit current by the A/F sensor 16, K1 to Kn+1 denote F/B constants, ZI shows an integration term, and Ka shows an integration constant. The suffixes 1 to n+1 are variables each showing the number of controls from the sampling start.

After setting the FAF value, in step 106, the CPU 31 calculates a final fuel injection amount TAU from the basic injection amount Tp, the air-fuel ratio correction coefficient FAF, and other correction coefficients FALL (various correction coefficients of coolant temperature, air-conditioner load, and the like) by using the following equation (3).

$$TAU=Tp\cdot FAF\cdot FALL \quad \ldots (3)$$

After calculating the fuel injection amount TAU, the CPU 31 outputs a control signal corresponding to the TAU value to the injector 18 and finishes the routine once.

Figure 3:
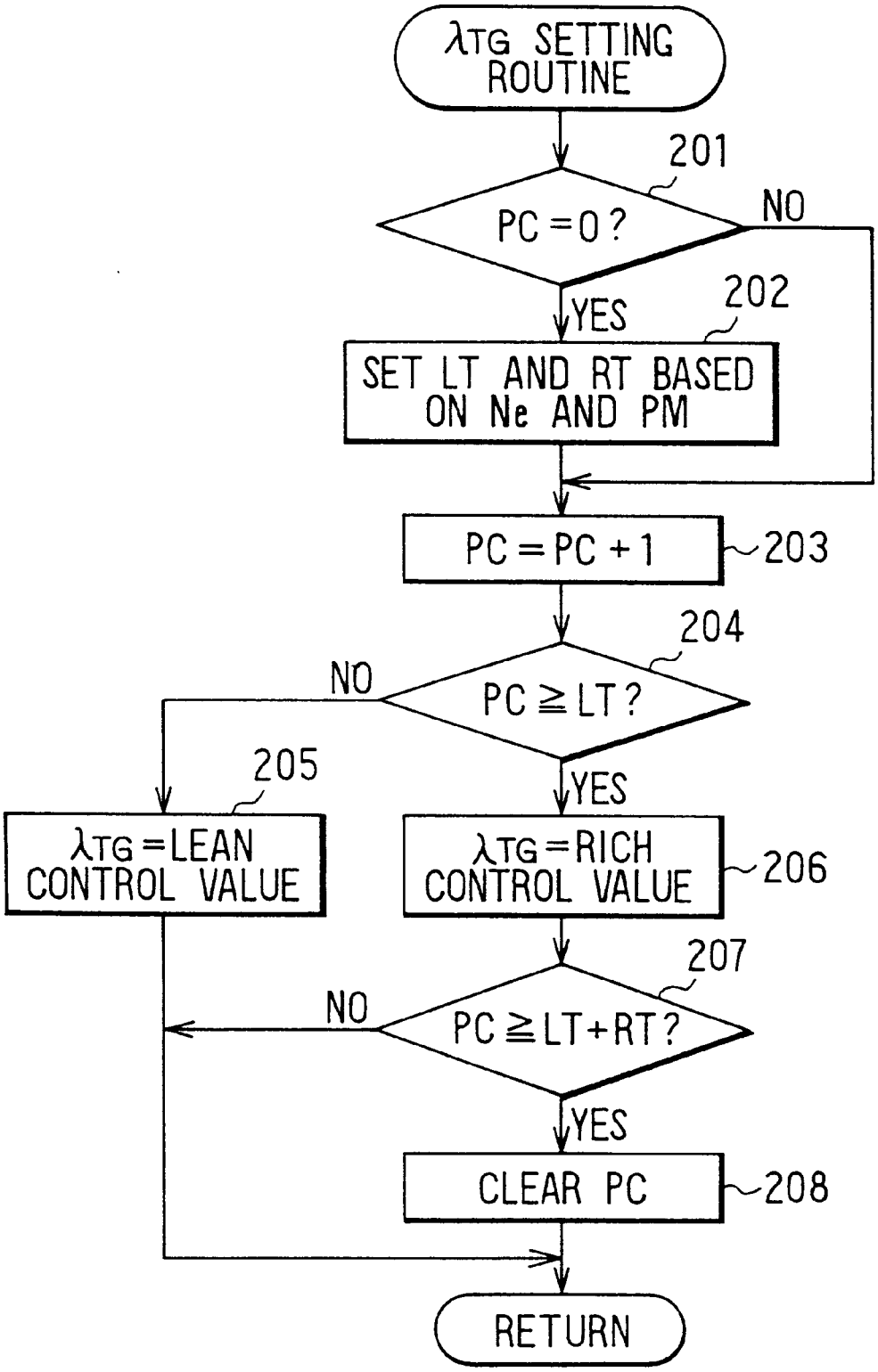
FIG. 3 is a flowchart showing a λTG setting routine in the first embodiment.

A λTG setting routine corresponding to the process of step 200 is shown in FIG. 3. In this routine, the target air-fuel ratio λTG is properly set in such a manner that the rich mixture combustion is performed temporarily during the execution of the lean mixture combustion. That is, in the embodiment, a lean time LT and a rich time RT are set so as to be at a predetermined time ratio on the basis of the value of a period counter PC which counts every fuel injection and the lean mixture combustion and the rich mixture combustion are alternately executed in accordance with the times LT and RT.

In FIG. 3, the CPU 31 discriminates whether the period counter PC at that time is "0" or not in step 201. On condition that PC=0 (YES in step 201), in step 202, the lean time TL and the rich time TR are set on the basis of the engine speed Ne and the intake pressure PM. In case of "NO" in step 201 (PC±0), the CPU 31 skips the process of step 202.

Figure 4:
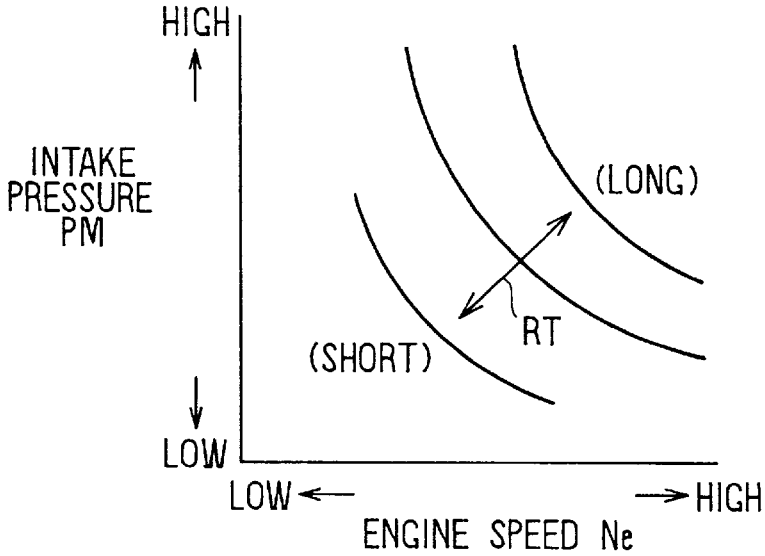
FIG. 4 is a data map used for setting a rich time in accordance with an engine speed and an intake pressure in the first embodiment.

The lean time LT and the rich time RT correspond to the number of fuel injection times at the lean air-fuel ratio and the number of fuel injection times at the rich air-fuel ratio, respectively. Basically, the higher the engine speed Ne is or the higher the intake pressure PM is, LT and RT are set to larger values. In the embodiment, the rich time RT is derived by retrieving a map data based on the relation of FIG. 4. The relation of FIG. 4 is set so as to realize the shortest rich time within a range in which a desired NOx purification rate by the NOx catalyst 19 is obtained.

Figure 5:
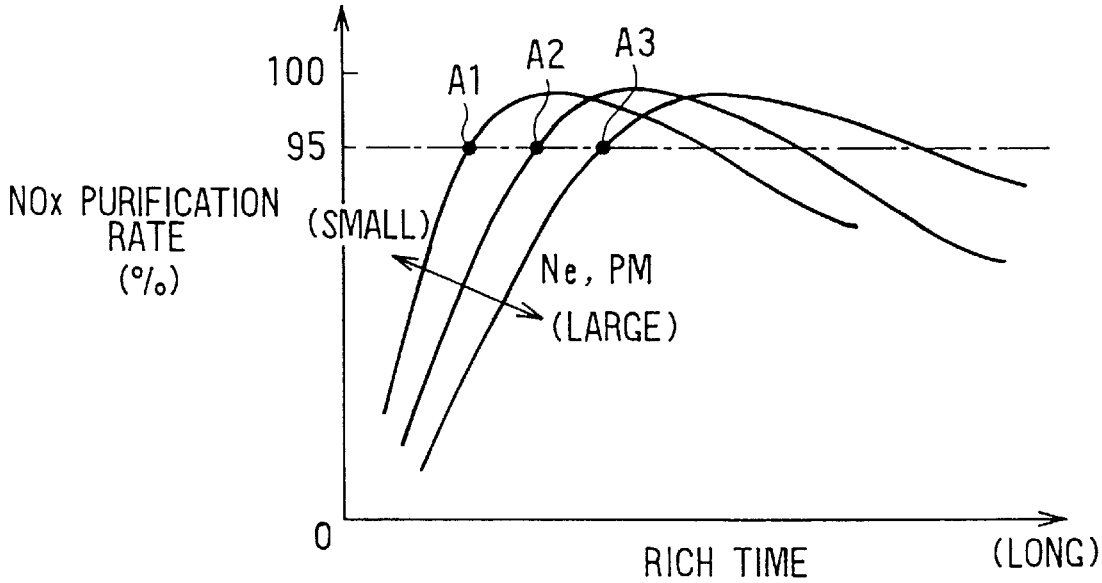
FIG. 5 is a graph showing a relation between the rich time and an NOx purification rate.

That is, the characteristic of the NOx purification rate with the rich time has the relation of FIG. 5. According to FIG. 5, the characteristic of the NOx purification rate changes depending on the engine operating state (engine speed Ne and intake pressure PM). Generally, the larger Ne and PM are, the more the characteristic of the NOx purification rate moves to the right side in the figure. The smaller Ne and PM are, the characteristic of the NOx purification rate moves to the left side of the drawing. In order to reduce the rich time while maintaining the NOx purification rate at a predetermined level (for example, 95% or higher in FIG. 5), therefore, the optimum rich time is obtained from A1, A2, and A3 in FIG. 5 in accordance with the states of Ne and PM (where A1<A2<A3).

On the other hand, the lean time LT is obtained from the rich time RT and a predetermined coefficient α as follows.

$$LT=RT\cdot\alpha$$

It is sufficient to set the coefficient α to a fixed value of approximately 100. The coefficient α can be also variably set in accordance with the engine operating state such as the engine speed Ne and the intake pressure PM.

After that, the CPU 31 increases the period counter PC by "1" in step 203. Then the CPU 31 discriminates whether the PC value reaches a value corresponding to the set lean time LT or not in step 204. When PC<LT and step 204 is discriminated negatively, the CPU 31 advances to step 205 and sets the target air-fuel ratio λTG as a lean control value on the basis of the engine speed Ne and the intake pressure PM at each time. After setting the λTG value, the CPU 31 is returned to the original routine of FIG. 2.

Figure 6:
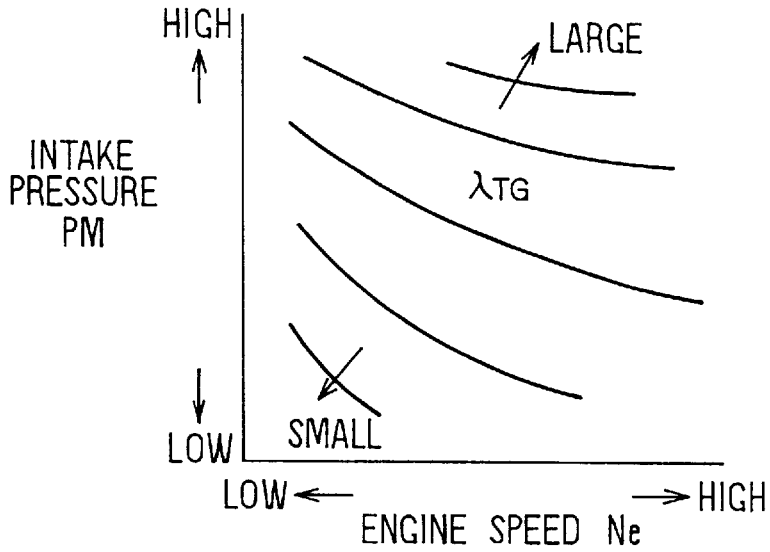
FIG. 6 is a data map used for setting the lean target air-fuel ratio in accordance with the engine speed and the intake pressure in the first embodiment.

In this case, the λTG value is obtained by, for example, retrieving the target air-fuel ratio map data shown in FIG. 6 and a value corresponding to, for instance, A/F=20 to 23 is set as the λTG value. When the lean mixture combustion executing conditions are not satisfied such as a case when the operation is not steady, the λTG value is set near the stoichiometric ratio. In such a case, the λTG value set in step 205 is used for the calculation of the FAF value in step 105 in FIG. 2 and the air-fuel ratio is controlled to the lean side by the FAF value.

When PC≧LT and step 204 is positively discriminated, the CPU 31 advances to step 206 and the target air-fuel ratio λTG is set as a rich control value. In this case, the λTG value can be set to a fixed value in the rich zone or variably set by retrieving the map data on the basis of the engine speed Ne and the intake pressure PM. In case of performing the map data retrieval, the λTG value is set so that the higher the engine speed Ne is or the higher the intake pressure PM is, the degree of richness becomes higher.

After that, the CPU 31 discriminates whether or not the PC value reaches a value corresponding to the sum "LT+RT" of the lean time LT and the rich time RT which have been set in step 207. When PC<LT+RT and step 207 is negatively discriminated, the CPU 31 returns to the original routine of FIG. 2. In such a case, the λTG value set in step 206 is used for the calculation of the FAF value in step 105 in FIG. 2 and the air-fuel ratio is controlled to be on the rich side by the FAF value.

On the other hand, when PC≧LT+RT and step 207 is discriminated positively, the CPU 31 clears the period counter to "0" in step 208 and returns to the original routine of FIG. 2. In association with the clearing operation of the period counter, step 201 is discriminated as YES in the next processing and the lean time LT and the rich time RT are newly set. The lean control and the rich control of the air-fuel ratio are executed again on the basis of the lean time LT and the rich time RT.

Figure 7:
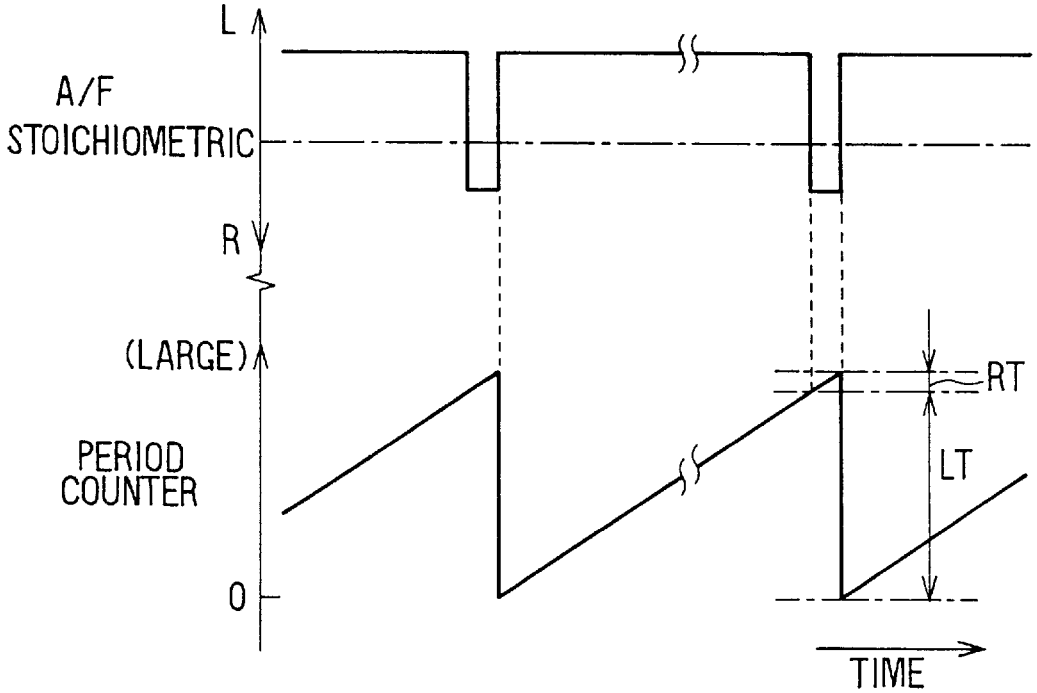
FIG. 7 is a time chart showing an operation of the first embodiment.

As shown in FIG. 7, during the period in which PC=0 to LT, the air-fuel ratio is controlled to be on the lean side. At this moment, NOx in the exhaust gas is occluded by the NOx catalyst 19. In the period in which PC=LT to LT+RT, the air-fuel ratio is controlled to the rich side. At this moment, the NOx occluded by the catalyst 19 is reduced and unburnt gas components (HC, CO) in the exhaust gas are released. In this manner, the lean control and the rich control of the air-fuel ratio are repeatedly executed in accordance with the lean time LT and the rich time RT.

According to the embodiment as described above in detail, the effects shown below are obtained.

(a) The rich time for the rich mixture combustion is set in accordance with the engine operating state and the NOx purification rate by the NOx catalyst 19. In short, since the rich time is set to be rather long by including a margin in the conventional apparatus, there is feared that deterioration in fuel consumption and torque fluctuation is caused. In the embodiment, however, by setting the rich time in accordance with the relations of FIGS. 4 and 5 to shorten the rich time, the inconvenience of the conventional apparatus can be solved. Even if the engine operating state changes, the proper rich mixture combustion can be always performed. As a result, the rich mixture combustion is executed for the optimum time and the improvement in fuel consumption and suppression in the torque fluctuation can be realized.

Figure 8:
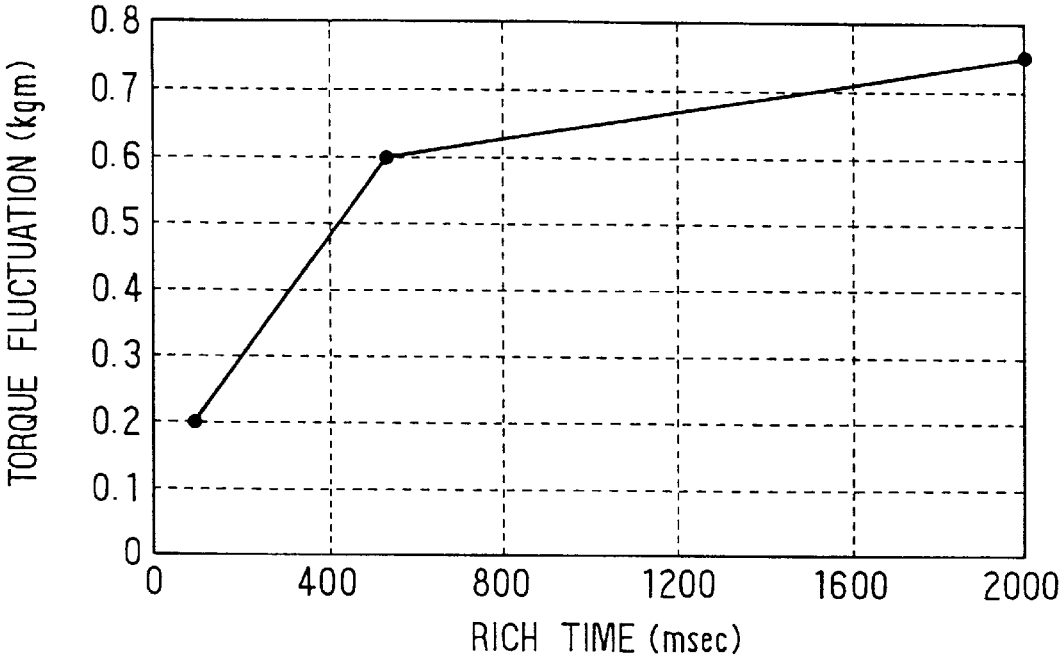
FIG. 8 is a graph showing a relation between rich time and torque fluctuation.

FIG. 8 shows experimental data showing the relation between the rich time per time and the torque fluctuation at each time. It is understood from the diagram that the shorter the rich time is, the more the torque fluctuation is suppressed.

(b) The shortest rich time is set within a range where a desired NOx purification rate by the NOx catalyst 19 is obtained. In this case, the optimum rich time can be set and the NOx purification performance by the NOx catalyst 19 can be maintained.

(Second Embodiment)

Figure 9:
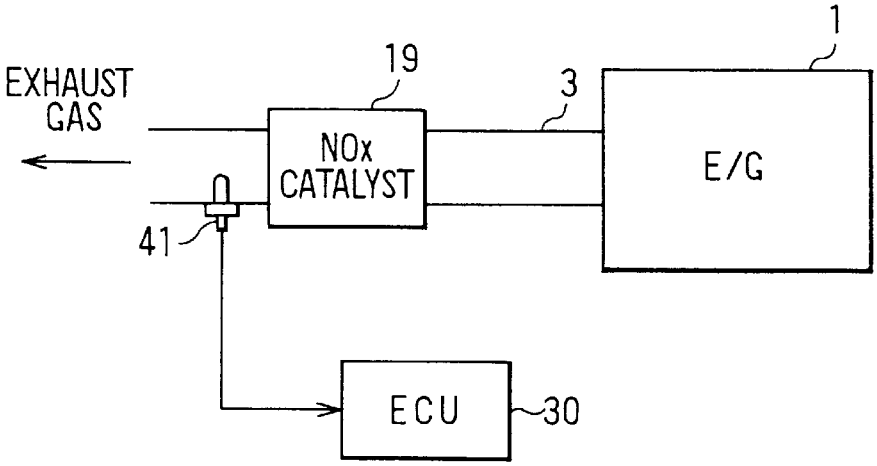
FIG. 9 is a schematic diagram showing an engine exhaust gas control system according to a second embodiment of the present invention.

This embodiment is characterized in that the rich time is learned one by one while monitoring the NOx purification state by the NOx catalyst 19 in order to optimally shorten the rich time. As shown in FIG. 9, an NOx sensor 41 serving as catalyst state detector is provided on the downstream side of the NOx catalyst 19 and an output of the sensor 41 is fetched by the ECU 30. The ECU 30 learns to gradually shorten the rich time while monitoring the output of the NOx sensor. When the output of the NOx sensor (NOx concentration) becomes a predetermined value or larger during the process for shortening the rich time, the rich time at that time is regarded as the minimum and is stored into the backup RAM 34 in the ECU 30.

The sensor 41 generates a current signal corresponding to the NOx concentration by using an oxygen ion conductive solid electrolyte substrate made of stabilized zirconia or the like.

Figure 10:
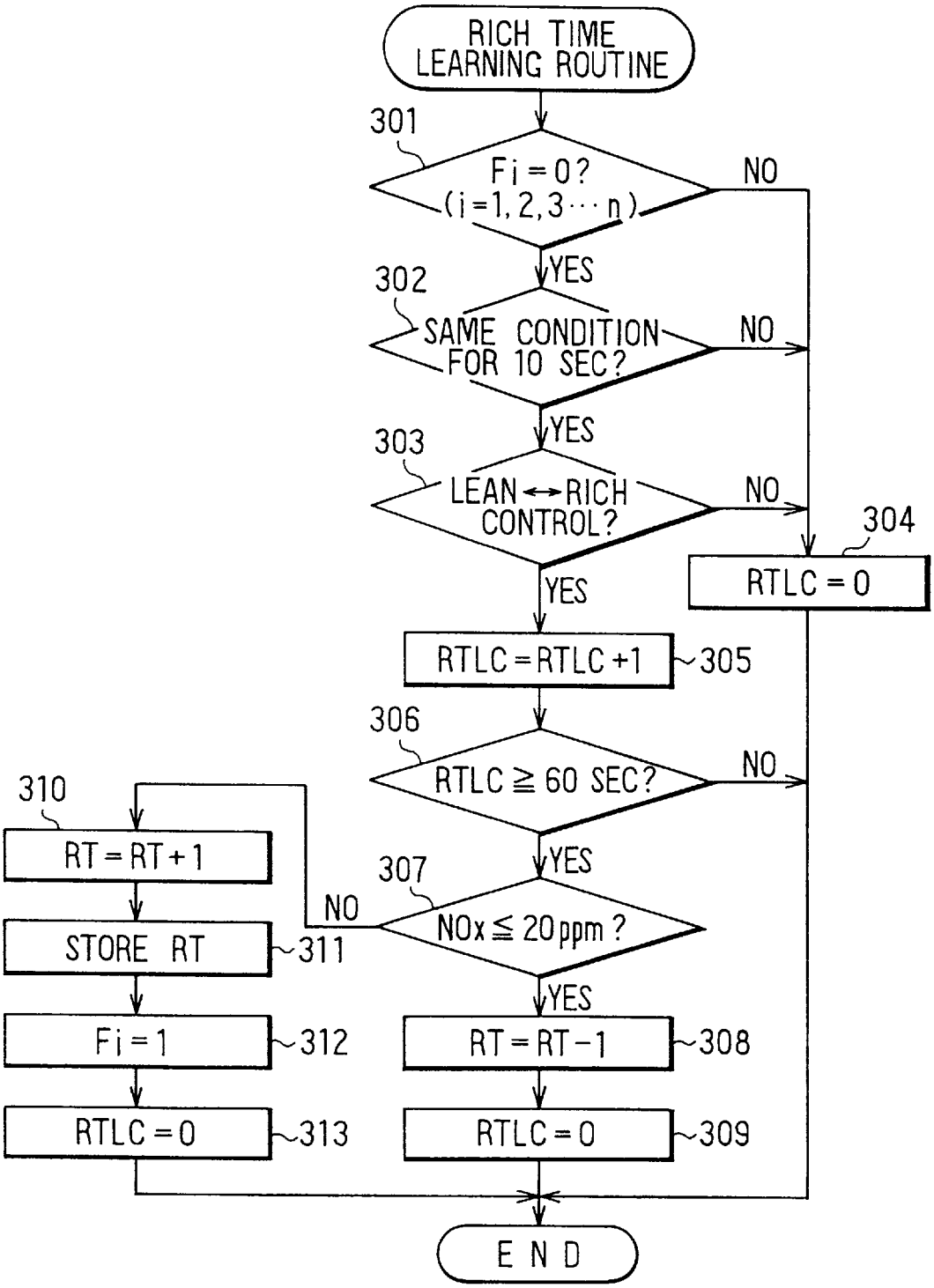
FIG. 10 is a flowchart showing a rich time learning routine in the second embodiment.

When the routine of FIG. 10 is starts, first in step 301, the CPU 31 discriminates whether a learning completion flag Fi when the engine operating state is in an "(i) zone (where, i=1, 2, 3, . . . n)" is "0" or not. The engine operating zone from 1 to n is set according to the engine speed Ne and the intake pressure PM and the learning completion flag Fi is provided for every operating zone. Fi=0 denotes that the learning of the rich time in the (i) zone has not been completed and Fi=1 denotes that the learning of the rich time in the (i) zone has been completed. The flag Fi is initialized to "0" in the beginning of activation of the routine.

In step 302, the CPU 31 discriminates whether or not a predetermined engine operating state is continued for 10 or more seconds. In the following step 303, whether the lean/rich switching is executed or not, that is, whether the stoichiometric operation is executed or not in the cases of low-temperature start of the engine 1, high load operation, and the like.

When NO in either one of the steps 301 to 303, the CPU 31 advances to step 304. When YES in all of the steps 301 to 303, the CPU 31 advances to step 305. In step 304, the CPU 31 clears the rich time learning counter RTLC for measuring time intervals of the rich time learning time to "0" and finishes the routine once.

In step 305, the CPU 31 increases RTLC by "1". In the following step 306, the CPU 31 discriminates whether the value of the RTLC at that time reaches a value corresponding to a predetermined time (60 seconds in the embodiment) or not. If RTLC<60 seconds, the CPU 31 finishes the routine as it is. If RTLC≧60 seconds, the CPU 31 advances to the next step 307. The time of "60 seconds" corresponds to a time required for rich time learning (learning period).

The CPU 31 discriminates whether the output value of the NOx sensor 41 is equal to or lower than a predetermined discrimination value for assuring a desired NOx purification rate (value corresponding to NOx concentration=20 ppm in the embodiment). In this case, it is preferable to average the NOx sensor outputs in one learning period and compare the calculated average value with the predetermined discrimination value (20 ppm).

In the case where NOx≦20 ppm, the CPU 31 regards that the rich time can be shortened more and shortens the rich time (the number of rich injection times) only by one injection in step 308. For example, the initial value of the rich time is set to about 10 injections. The CPU 31 clears RTLC to "0" in the following step 309 and finishes the routine. In this manner, in the state where the discrimination result of step 307 is YES, the rich time is gradually shortened.

On the other hand, when NOx>20 ppm, the CPU 31 regards that the desired NOx purification rate cannot be assured with the present rich time and increases the rich time (the number of rich injections) only by one injection in step 310. The CPU 31 stores the rich time at that time into the backup RAM 34 in the following step 311. In this instance, the rich time learned is stored for every engine operation state (every zone from 1 to n) at each time. The learned value of the rich time stored in the backup RAM 34 is stored and held even if the power source is disconnected.

After that, the CPU 31 sets "1" to the learning completion flag Fi corresponding to the operation zone i (=1 to n) at that time in step 312, clears the rich time learning counter to "0" in the following step 313, and finishes the routine.

When the rich time is learned and the value is updated as above, in step 202 in FIG. 3, the rich time according to the operation zone i (=1 to n) at each time is read out from the backup RAM 34. In this instance, the lean time is calculated as follows.

$$\text{lean time}=\alpha\cdot RT$$

where, the coefficient $\alpha$ can be set to a fixed value of about "100" or variably set according to the engine operating state such as the engine speed Ne and the intake pressure PM.

The operation according to FIG. 10 will be described more specifically by using the time chart of FIG. 11.

Figure 11:
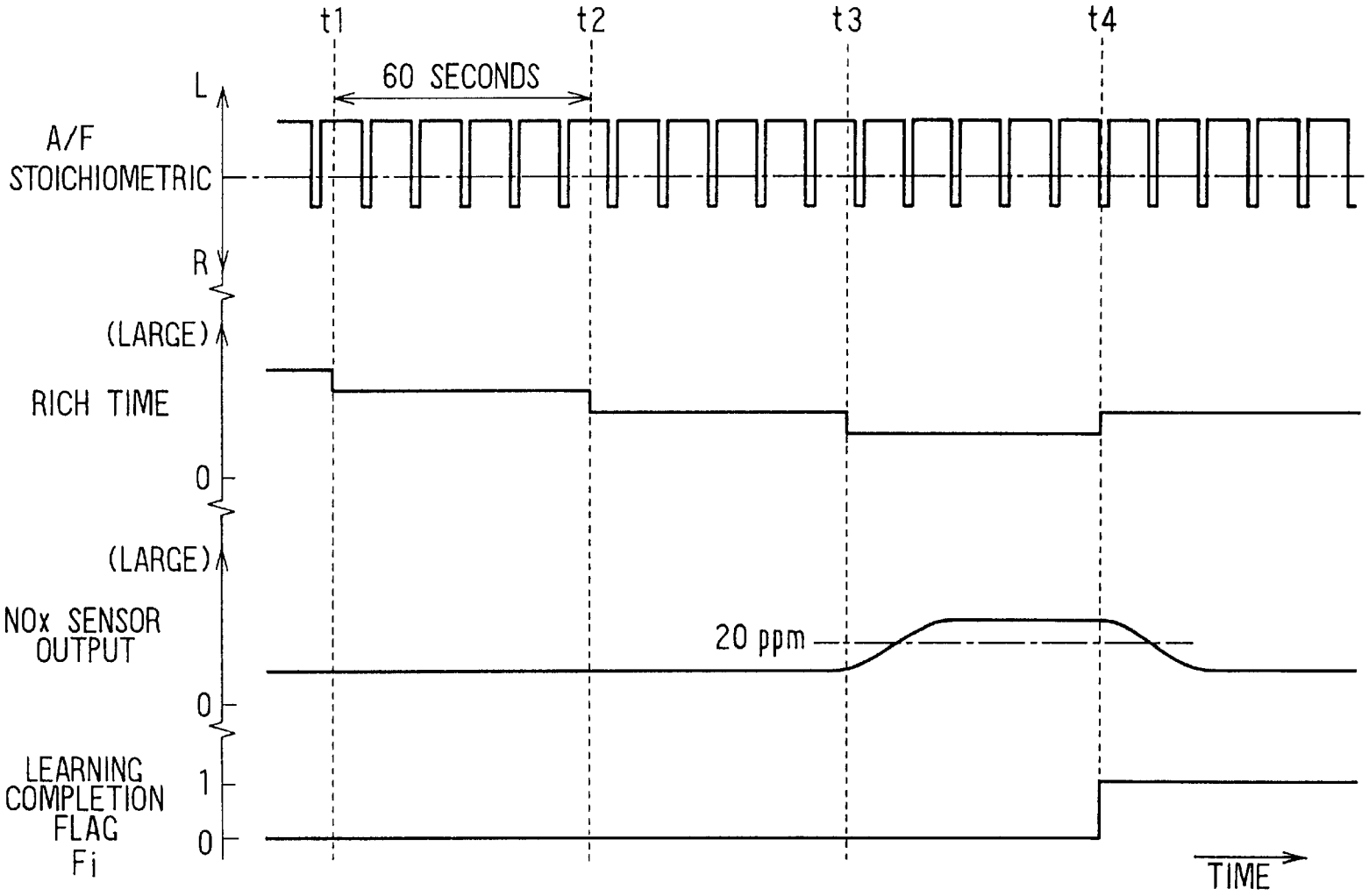
FIG. 11 is a time chart showing an operation of the second embodiment.

In FIG. 11, each of the periods defined by times t1 to t4 shows a rich time learning period (60 seconds in the embodiment). At the times t1, t2, and t3, the output of the NOx sensor (average value in the learning period) is below the predetermined value (20 ppm). Consequently, the rich time is shortened only by one injection (step 308 in FIG. 10).

On the contrary, at the time t4, the output (average value in the term from time t3 to time t4) of the NOx sensor exceeds the predetermined value (20 ppm). The rich time of one injection is therefore added and the resultant rich time is stored as a learned value into the memory (steps 310 and 311 in FIG. 10). At the time t4, "1" is set to the learning completion flag Fi (step 312 in FIG. 10).

According to the second embodiment described above in detail, the following effects can be obtained.

(a') When the rich time is gradually updated so as to be shortened while monitoring the NOx purifying state by the NOx catalyst 19 and the rich time at that time is discriminated as a limit value from the NOx purified state by the catalyst 19, the updating of the rich time to shorten the rich time is cancelled. By the operation, the rich time can be shortened while assuring the NOx purifying performance of the NOx catalyst 19. In such a case as well, the rich mixture combustion is carried out for the optimum time and the improvement in the fuel consumption and the suppression of torque fluctuation can be realized.

(b') The NOx sensor 41 is provided on the downstream side of the NOx catalyst 19 and the degree of the NOx purification by the NOx catalyst 19 is discriminated based on the output of the sensor. Consequently, the shortening of the rich time is permitted or prohibited on the basis of the output (NOx concentration) of the NOx sensor and the rich time can be properly learned.

(c') The learned value of rich time is stored every operating zone of the engine 1. Consequently, the rich time according to the engine operating state can be set each time so that a change in the operating state can be properly dealt with.

(d') When it is discriminated that the rich time reaches the limit value of the shortening on the basis of the output of the NOx sensor, the rich time is updated to the opposite side (time corresponding to one injection is added). In this case, even if the rich time is shortened excessively, the rich time can be corrected. The optimum rich time can be always set even when the rich time has to be prolonged due to a change with time such as deterioration of the NOx catalyst 19.

(Third embodiment)

The third embodiment is characterized in that, in the event of lean/rich control, an actual rich time is estimated from a rich time control instruction value for the rich mixture combustion and the engine operating state at each time and the lean time is set on the basis of the actual rich time.

Figure 12:
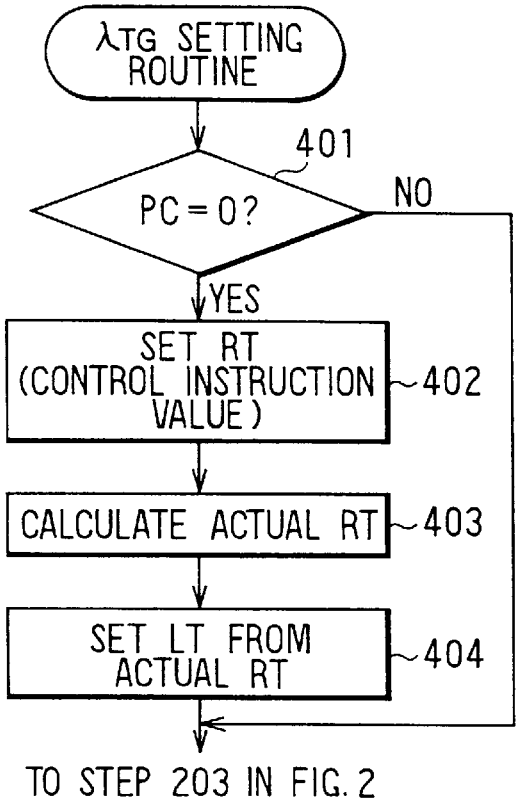
FIG. 12 is a flowchart showing a part of λTG setting routine in a third embodiment.

In this embodiment, a part of the λTG setting routine in the first embodiment is modified as shown in FIG. 12. The flowchart is executed in place of a part (steps 201 and 202) of the flowchart of FIG. 3.

In the routine of FIG. 12, on condition that the period counter PC at that time is "0" (YES in step 401), the CPU 31 sets the rich time (control instruction value) on the basis of the engine speed Ne and the intake pressure PM at each time in step 402. The higher the engine speed Ne is or the higher the intake pressure PM is, the rich time (control instruction value) is set to a larger value (FIG. 4). In this instance, however, the rich time is guarded by the lower limit value according to the engine operating state at each time so that the exhaust gas supplied to the NOx catalyst 19 is certainly switched to the rich side. This is because that, when the rich time is shortened excessively, even if the air-fuel ratio is switched from lean to rich, the air-fuel ratio of the exhaust gas at the entrance of the catalyst does not become rich and NOx cannot be substantially reduced.

In the following step 403, the CPU 31 calculates the actual rich time. The actual rich time is a time required for the air-fuel ratio of the exhaust gas at the entrance of the catalyst actually to become rich. For instance, the actual rich time is calculated as follows.

$$\text{Actual RT}=\beta\cdot\text{RT (control instruction value)}$$

Figure 13:
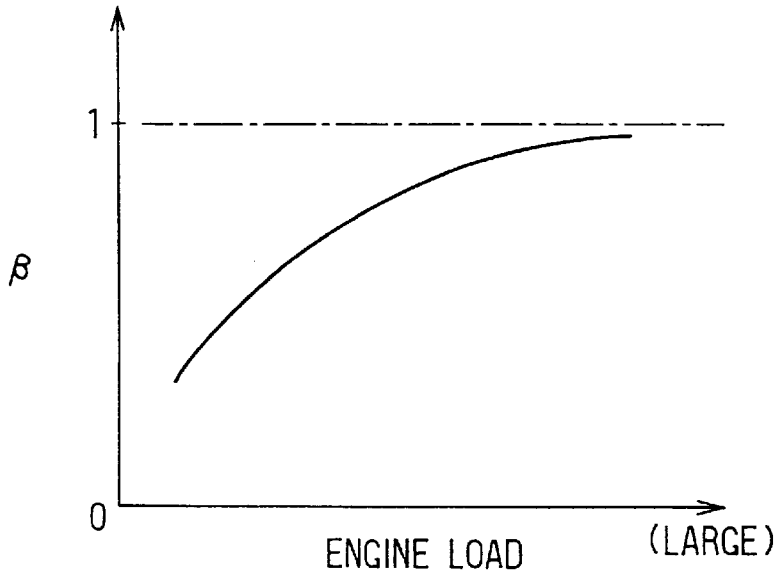
FIG. 13 is a graph showing a relation between an engine load and a coefficient a in the third embodiment.

The coefficient β is set according to an engine load such as the intake pressure PM and the throttle opening angle as shown in FIG. 13. That is, the smaller the engine load is, since mixing of the exhaust gas is delayed, the smaller value is set for the coefficient β.

After that, the CPU 31 sets the lean time LT on the basis of the actual rich time RT calculated in step 404. The lean time is calculated as follows.

$$\text{LT}=\alpha 1\cdot\text{actual RT}$$

Figure 14:
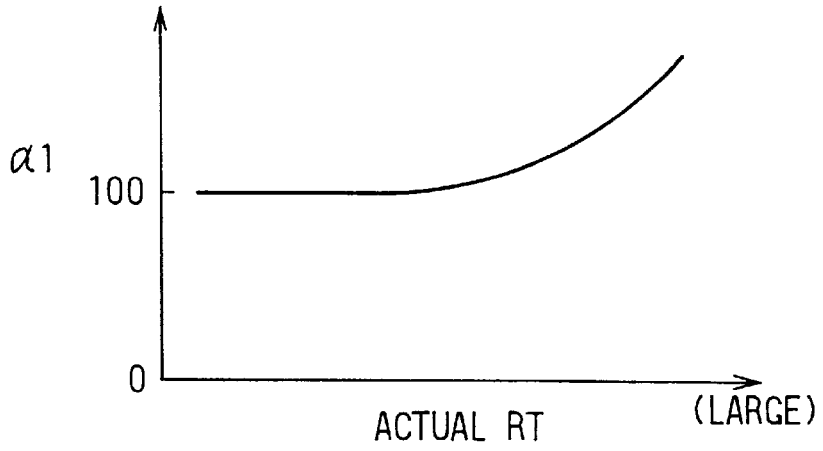
FIG. 14 is a graph showing a relation between an actual rich time and a coefficient α1 in the third embodiment.

The coefficient α1 is obtained on the basis of, for example, the relation shown in FIG. 14. The longer the actual rich time is, the larger value is set as the coefficient α1.

After that, the CPU 31 alternately executes the above lean control and the rich control of the air-fuel ratio in accordance with steps 203 to 208 in FIG. 3.

Figure 15:
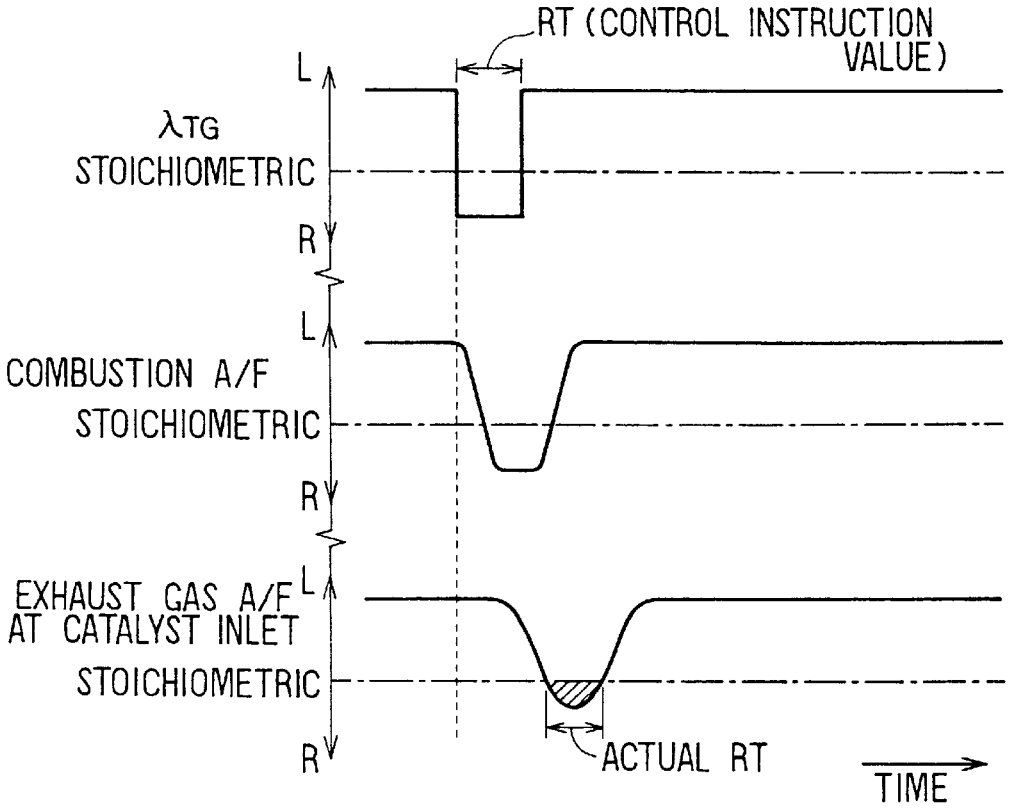
FIG. 15 is a time chart showing an operation of the third embodiment.

As shown in FIG. 15, when the target air-fuel ratio λTG is switched from lean to rich with a predetermined rich time (control instruction value), a change in the air-fuel ratio (combustion A/F) of a mixture flowing into the engine combustion chamber becomes slow by the influences such as the fuel wet. Further, the air-fuel ratio of the exhaust gas (exhaust gas A/F) when the exhaust gas reaches the NOx catalyst 19 becomes more slow due to mixture with exhaust gases of other cylinders or a delay in transfer in the exhaust pipe. Consequently, the time required for the air-fuel ratio of the exhaust gas at the entrance of the catalyst to actually become rich (actual rich time) is slightly shorter than the control instruction value. In such a case, the rich control of the air-fuel ratio is executed on the basis of a predetermined rich time (control instruction value) and the lean control of the air-fuel ratio is performed based on the actual rich time.

According to the third embodiment as mentioned above in detail, the following effects can be obtained.

(a") The actual rich time as compared with the rich time (control instruction value) is estimated on the basis of the engine operating state and the lean time is set from the estimated actual rich time. In this case, the lean time can be set properly. Even if the actual rich time is set rather short, NOx is not exhausted unguardedly due to lean mixture combustion shortage. As a result, the rich mixture combustion can be carried out in the optimal time and the improvement in the fuel consumption and suppression of the torque fluctuation can be realized.

(b") It is estimated that the lower the load on the engine 1 is, the actual rich time as compared with the rich time instruction value becomes shorter. In this case, even under the condition of a low load in which the lean/rich switching of the exhaust gas air-fuel ratio is delayed, the rich time and the lean time can be properly set.

The embodiments of the invention can be realized also in the following modes.

For example, the throttle opening angle, the accelerator opening angle, and the like can be also used as parameters to detect the engine operating state.

Another air-fuel ratio sensor may be disposed downstream the Nox catalyst 19. The catalyst state may be discriminated from the responses (response speeds) before and after the catalyst at the time of lean←→rich switching of the air-fuel ratio and the learning of the rich time is permitted or inhibited on the basis of the discrimination result. As the air-fuel ratio sensor used in this case, a known A/F sensor (limit current type air-fuel ratio sensor) for outputting a linear current signal according to the concentration of oxygen, a known $O_2$ sensor for outputting different voltage signals in accordance with the lean and rich sides relative to the stoichiometric ratio as a border, or the like can be applied.

The rich time corresponding to two or more injection times can be also updated per time. In this case, it is more preferable to variably set the updating width in consideration of the margin to the limit value, for example, on the basis of the output of the NOx sensor.

The rich time may be learned again from the initial value (for example, time corresponding to ten injection times) each time the power source is turned on.

The rich time (control instruction value) can be changed to set the control instruction value of the same time by using the rich time learned value described in the second embodiment.

Although the lean mixture combustion and the rich mixture combustion are performed by switching the target air-fuel ratio λ by the lean and rich control values in the foregoing embodiments, this can be also changed. For example, the air-fuel ratio correction coefficient FAF is switched on the lean correction side and the rich correction side, thereby carrying out the lean mixture combustion and the rich mixture combustion.

In the air-fuel ratio control system in each of the embodiments, the air-fuel ratio is feedback controlled in accordance with the deviation between the target air-fuel ratio and the actually detected air-fuel ratio (actual air-fuel ratio) by using the advanced control theory. The air-fuel ratio can be feedback controlled by a proportional-integral (P-I) control or can be also open-loop controlled.

(Fourth Embodiment)

Figure 16:
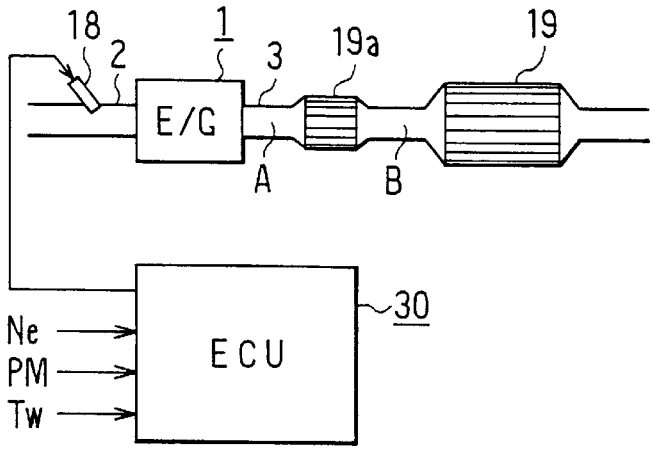
FIG. 16 is a schematic diagram of an engine exhaust gas control system according to a fourth embodiment of the present invention.

In this embodiment, as shown in FIG. 16, a three-way catalyst 19*a* to purify three components of HC, CO, and NOx contained in the exhaust gas is provided upstream the NOx catalyst 19 having the NOx occluding and reducing function. The capacity of the three-way catalyst 19*a* is smaller than that of the NOx catalyst 19. The three-way catalyst 19*a* operates as a start catalyst to be activated soon after a low temperature starting of the engine 1 to purify the noxious gas.

The ECU 30 may be programmed to execute various control routines described with reference to the first to third embodiments. Thus, also in this embodiment, the lean mixture combustion in the lean air-fuel ratio zone is carried out normally, and the rich mixture combustion is carried out temporarily during the lean combustion.

In the three-way catalyst 19*a* according to this embodiment, only a noble metal incapable of storing oxygen is carried as a catalyst material on a carrier. More specifically, the carrier made of a stainless steel or ceramics such as cordierite is coated with a catalytic layer. This catalytic layer is constructed by carrying only platinum (Pt) on the surface of porous alumina ($Al_2O_3$).

The three-way catalyst 19*a* of the above structure eliminates the inconvenience such that the oxygen stored in the catalyst 19*a* reacts with the rich components (HC, CO) in the exhaust gas and the rich components cannot be supplied to the downstream side. That is, since the storing of the oxygen by the three-way catalyst 19*a* is extremely suppressed, the rich components sufficient to reduce and release the occluded NOx are supplied to the NOx catalyst 19, and the rich components in the exhaust gas are efficiently utilized for reducing and releasing the occluded NOx.

Figure 17:
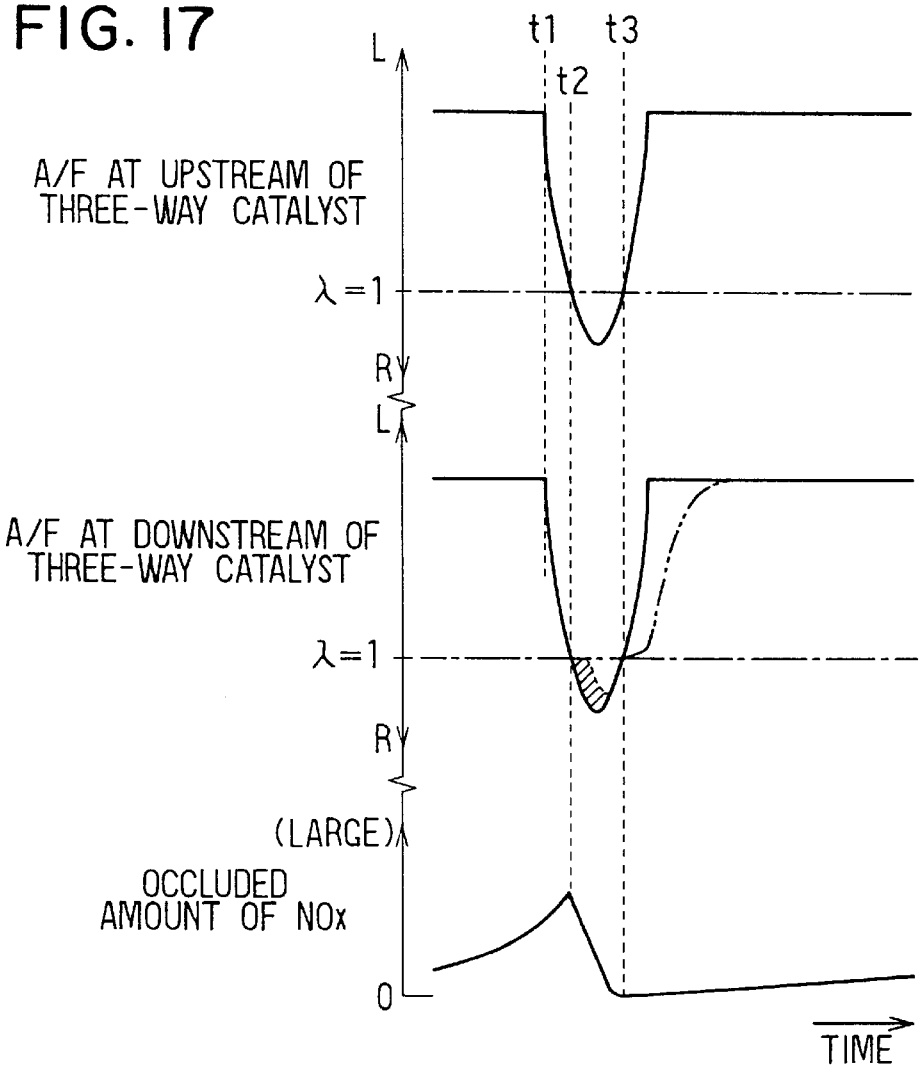
FIG. 17 is a time chart showing a transition of the air-fuel ratio on the upstream side of a three-way catalyst to that on the downstream side in the fourth embodiment.

In FIG. 17, when the lean mixture combustion is temporarily switched to the rich mixture combustion, the air-fuel ratio (A/F) at upstream of the three-way catalyst 19*a* changes as shown by (a), the air-fuel ratio (A/F) at downstream of the three-way catalyst 19*a* changes as shown by (b), and the amount of occluded NOx in the NOx catalyst 19 changes as shown by (c).

When the air-fuel ratio is switched from a lean value to a rich value at a time t1, accordingly, the air-fuel ratio on the upstream side of the three-way catalyst 19*a* starts to change to the rich side. When the air-fuel ratios on the upstream and downstream sides of the catalyst 19*a* become rich relative to the stoichiometric air-fuel ratio (λ=1), the NOx occluded by the NOx catalyst 19 is reduced and released and the NOx occluded amount starts to be decreased. In practice, although the air-fuel ratio on the downstream side of the catalyst 19*a* changes slightly after the air-fuel ratio on the upstream side of the catalyst 19*a* due to a delay in transfer of the exhaust gas, those are shown synchronously in FIG. 17 for convenience.

After that, when the air-fuel ratio is returned to the lean value from the rich value, the air-fuel ratios of start to change to the lean side and return to the lean zone at time t3. During the period from t2 to t3, the air-fuel ratio at the downstream of the three-way catalyst 19*a* shown by (b) enters into the rich zone, so that almost all of the NOx occluded by the NOx catalyst 19 is reduced and released. In this case, since the oxygen storage amount of the three-way catalyst 19*a* is regulated to the minimum as mentioned above, the degree of richness of the air-fuel ratio downstream the three-way catalyst 19*a* will not be reduced and the substantial rich period will not be shortened. This operation is substantially the same as the case where the three-way catalyst 19*a* is not provided upstream the NOx catalyst 19.

The transition of the air-fuel ratio shown by two-dot chain line in FIG. 17 shows, for comparison, a case in which a three-way catalyst (or oxidizing catalyst) having the high oxygen storing ability is provided on the upstream side of the NOx catalyst. In such a case, the oxygen stored in the three-way catalyst reacts with the rich components in the exhaust gas. The air-fuel ratio is held once at the stoichiometric air-fuel ratio just after the time t2 and is shifted to the rich side. Consequently, the degree of richness of the air-fuel ratio at the downstream of the three-way catalyst 19*a* decreases and the rich period is shortened.

That is, in the device of the embodiment, the rich components are increased by an amount corresponding to the hatched area of FIG. 17 and the increased rich components are supplied to the NOx catalyst 19. Thus, the NOx occluded in the NOx catalyst 19 can be efficiently reduced and released by the increased rich components.

Figure 18:
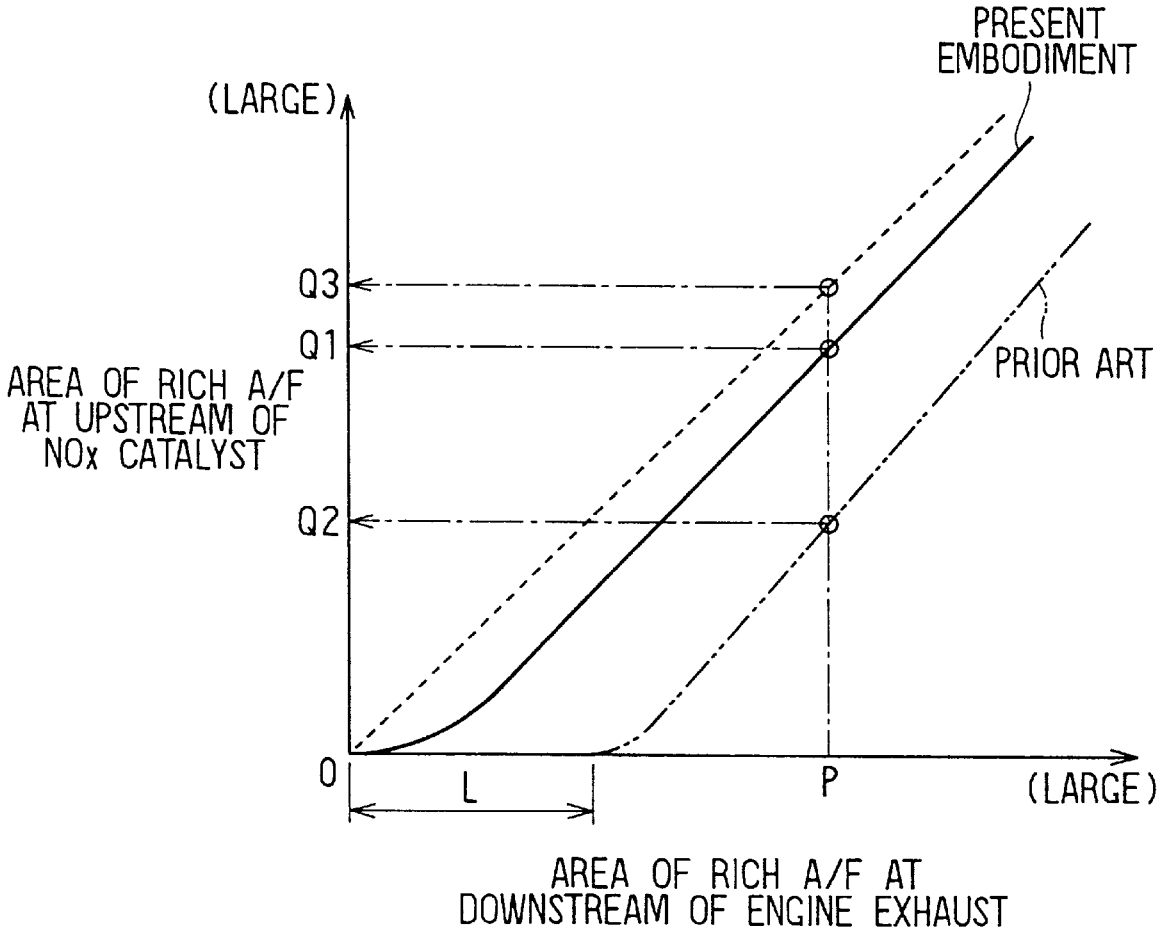
FIG. 18 is a graph showing a rich air-fuel ratio just downstream an engine exhaust with that just upstream an NOx catalyst in terms of area in the fourth embodiment.

FIG. 18 shows the area of the rich air-fuel ratio of exhaust gas (exhaust gas at the point A in FIG. 16) just downstream exhausted from the engine with the area of the rich air-fuel ratio of exhaust gas (exhaust gas at the point B in FIG. 16) just upstream the NOx catalyst when rich gas is supplied (for example, time t2 to t3 in FIG. 17). The area of the rich air-fuel ratio corresponds to an integration value of a deviation to the rich side from λ=1. The solid line in FIG. 17 shows the characteristic of the fourth embodiment, the two-dot chain line shows the characteristic of the prior art device, and the dotted line indicates the characteristic when the three-way catalyst 19*a* is not provided upstream the NOx catalyst. When the three-way catalyst 19*a* is not provided, since the components of the exhaust gas just downstream the engine exhaust and those of the exhaust gas at the upstream of the NOx catalyst are the same, the areas of the rich parts of those coincide with each other (the ratio of a value on the axis of abscissa and that on the axis of ordinate is 1:1).

For example, when the area of the rich air-fuel ratio just downstream the engine exhaust is "P":

in case of the embodiment, the area of the rich air-fuel ratio just upstream the NOx catalyst is "Q1";

in case of the prior art device, the area of the rich air-fuel ratio just upstream the NOx catalyst is "Q2"; and in the case where the three-way catalyst 19*a* is not provided, the area of the rich air-fuel ratio just upstream the NOx catalyst is "Q3" (where, P=Q3, Q3>Q1>>Q2).

It is understood from FIG. 18 that, in case of the embodiment, although the area of the rich air-fuel ratio just upstream the NOx catalyst is reduced slightly as compared with the case where the three-way catalyst 19*a* is not provided, the area increases largely as compared with the prior art device. As for the characteristic of the prior art, in the range of "L" of the axis of abscissa, even if the rich air-fuel ratio just downstream the engine exhaust increases, the rich air-fuel ratio just upstream the NOx catalyst does not increase by the oxygen occluded by the three-way catalyst 19*a* on the upstream side of the NOx catalyst and remains at "0". That is, the range L corresponds to the oxygen storing amount in the three-way catalyst 19*a* on the upstream side of the NOx catalyst 19 and causes deterioration in the NOx purification rate.

According to the fourth embodiment, the catalyst material having the structure that only platinum (Pt) incapable of storing oxygen is carried on the carrier is used as the three-way catalyst 19*a* disposed on the upstream side of the NOx catalyst 19. It is therefore possible to supply the rich components sufficient to reduce and release the occluded NOx to the NOx catalyst 19 without prolonging the rich time more than it needs. As a result, the NOx purification rate of the NOx catalyst 19 can be improved in the exhaust system having the three-way catalyst 19*a* and the NOx catalyst 19.

Since the three-way catalyst 19*a* is used as the start catalyst, the emission can be reduced while satisfying the request of the quick activation of the catalyst.

The embodiment of the invention can be modified as follows.

The three-way catalyst 19*a* is constructed in such a manner that a co-catalyst having the high oxygen storing ability is not carried on the carrier or only a small amount of a co-catalyst is carried on the carrier. In this case, as co-catalysts having the high oxygen occluding ability, ceria ($CeO_2$), barium (B), lanthanum (La) and the like may be used. In this case as well, the NOx purification rate of the NOx catalyst 19 can be improved.

The three-way catalyst 19*a* can be also constructed in such a manner that the amount of noble metals (Rh, Pd) capable of storing oxygen carried on the catalyst is reduced. Especially, it is preferable that the carrying amount in case of Rh is 0.2 grams/liter or less and that in case of Rd is 2.5 grams/liter or less.

Although the three-way catalyst 19*a* is provided on the upstream side of the NOx catalyst 19 in the embodiment, the three-way catalyst 19*a* can be changed to an oxidizing catalyst. That is, any construction as long as the catalyst having the oxidizing action is provided upstream of the NOx catalyst can be used.

It is to be noted that the present invention should not be limited to the disclosed embodiments and modifications, but may be implemented in other ways without departing from the spirit of the invention.

What is claimed is:

1. A control system for an internal combustion engine, comprising:

air-fuel ratio control means for normally controlling an air-fuel ratio of air-fuel mixture supplied to the internal combustion engine to a lean side with respect to a stoichiometric ratio for a lean mixture combustion, and temporarily controlling the air-fuel ratio to a rich side with respect to the stoichiometric air-fuel ratio;

NOx catalyst means for occluding Nox in an exhaust gas exhausted at the time of the lean mixture combustion and releasing the occluded NOx from the NOx catalyst by temporarily controlling the air-fuel ratio to the rich side for a rich mixture combustion; and rich time setting means for setting a rich time for the rich mixture combustion in accordance with an engine operating state and an NOx purification rate by the NOx catalyst.

2. The control system as in claim 1, wherein:

the rich time setting means sets a shortest rich time within a range where a desired NOx purification rate by the NOx catalyst can be obtained.

3. The control system as in claim 1, further comprising:

catalyst state detecting means for detecting the NOx purification state of the NOx catalyst;

rich time updating means for updating the rich time for the rich mixture combustion so as to be shortened in a predetermined time period; and update cancelling means for cancelling an update of the rich time so as to be shortened when the rich time at that time is discriminated as a limit value from the detected NOx purification state of the catalyst.

4. The control system as in claim 3, wherein:

the catalyst state detecting means comprises a gas concentration sensor provided on a downstream side of the NOx catalyst, and discriminating means for discriminating a degree of NOx purification of the NOx catalyst on the basis of an output value of the sensor.

5. The control system as in claim 3, further comprising:

storing means for storing the updated rich time for every operating zone of the internal combustion engine.

6. The control system as in claim 1, wherein:

the NOx catalyst means is disposed in an engine exhaust system for occluding and reducing NOx; and another catalyst means is disposed upstream of the first catalyst means and has at least an oxidizing operation.

7. The control system as in claim 6, wherein:

the rich time setting means varies the rich time in accordance with a capacity of occluding NOx in the NOx catalyst means.

* * * * *